US006957866B1

(12) United States Patent
Cai

(10) Patent No.: US 6,957,866 B1
(45) Date of Patent: Oct. 25, 2005

(54) ADJUSTABLE ARMREST ASSEMBLY FOR CHAIR

(76) Inventor: Bo-Quan Cai, 58, Ma Yuan West St., Taichung (TW)

( * ) Notice: Subject to any disclaimer, the term of this patent is extended or adjusted under 35 U.S.C. 154(b) by 32 days.

(21) Appl. No.: 10/929,062

(22) Filed: Aug. 30, 2004

(51) Int. Cl.[7] ..... A47C 7/54
(52) U.S. Cl. ..... 297/411.35
(58) Field of Search ..... 248/231.71, 118, 248/118.1; 297/411.35, 151, 143, 138, 423.2, 297/411.2, 411.37

(56) References Cited

U.S. PATENT DOCUMENTS 3,490,808 A * 1/1970 Siegel ..... 297/153
3,767,260 A * 10/1973 Limpach ..... 297/411.3
4,576,351 A * 3/1986 Brink ..... 248/118
5,388,359 A * 2/1995 DeWitt ..... 40/607.14
5,743,499 A * 4/1998 Wang ..... 248/118
6,074,012 A * 6/2000 Wu ..... 297/411.26

* cited by examiner

*Primary Examiner*—Milton Nelson, Jr.
(74) *Attorney, Agent, or Firm*—Alan D. Kamrath; Nikolai & Mersereau, P.A.

(57) ABSTRACT

An adjustable armrest assembly for a chair includes an arm support having an end formed with a connecting body, a slide slidably mounted and detachably locked on the connecting body of the arm support, and an armrest secured to the slide. Thus, the position of the armrest is adjustable to fit users of different statures, so that the user's hands are placed on the armrest in a comfortable manner. In addition, the position of the armrest is adjusted easily and conveniently, thereby facilitating the user adjusting the position of the armrest.

12 Claims, 5 Drawing Sheets

ADJUSTABLE ARMREST ASSEMBLY FOR CHAIR

BACKGROUND OF THE INVENTION

1. Field of the Invention

The present invention relates to an adjustable armrest assembly, and more particularly to an adjustable armrest assembly for a chair.

2. Description of the Related Art

A conventional chair comprises a seat, and two armrests mounted on the seat to support a user's two hands. However, each of the armrests is fixed on the seat and cannot be adjusted to fit users of different statures, so that the user's hands are easily placed on the armrest in a uncomfortable manner.

SUMMARY OF THE INVENTION

In accordance with the present invention, there is provided an adjustable armrest assembly, comprising:

an arm support having an end formed with a connecting body;

a slide slidably mounted and detachably locked on the connecting body of the arm support; and an armrest secured to the slide.

The primary objective of the present invention is to provide an adjustable armrest assembly for a chair.

Another objective of the present invention is to provide an adjustable armrest assembly, wherein the position of the armrest is adjustable to fit users of different statures, so that the user's hands are placed on the armrest in a comfortable manner.

A further objective of the present invention is to provide an adjustable armrest assembly, wherein the position of the armrest is adjusted easily and conveniently, thereby facilitating the user adjusting the position of the armrest.

Further benefits and advantages of the present invention will become apparent after a careful reading of the detailed description with appropriate reference to the accompanying drawings.

DETAILED DESCRIPTION OF THE INVENTION

Figure 1:
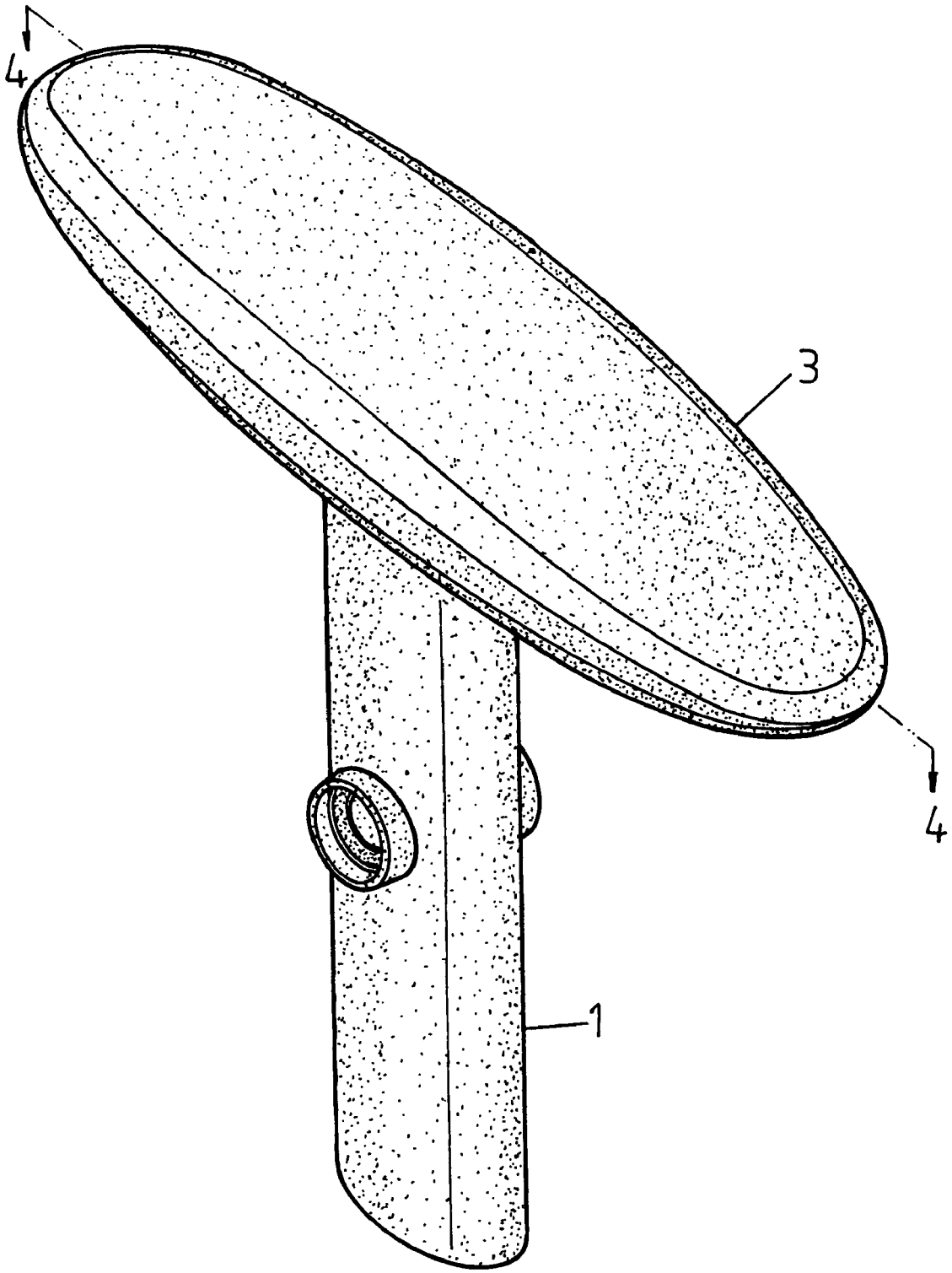
FIG. 1 is a perspective view of an adjustable armrest assembly in accordance with the preferred embodiment of the present invention.
Figure 2:
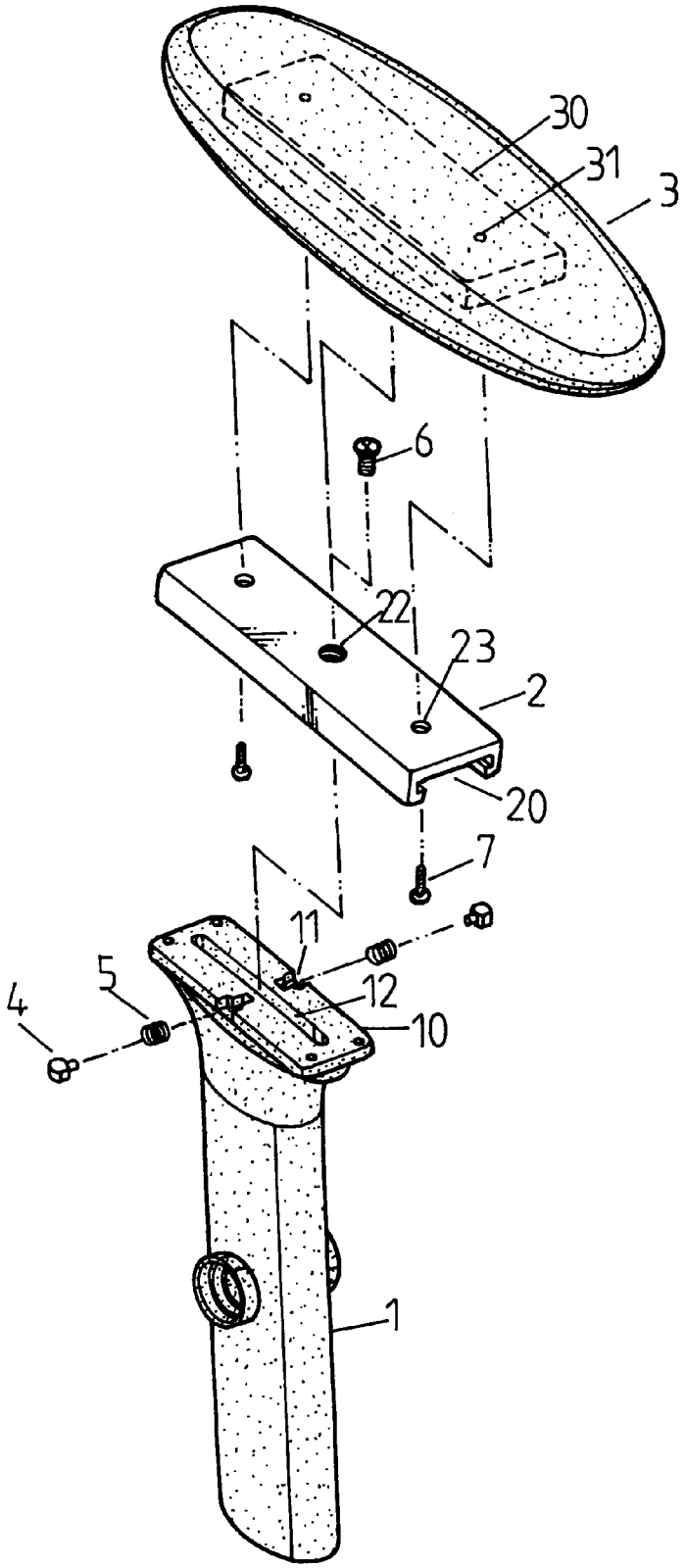
FIG. 2 is an exploded perspective view of the adjustable armrest assembly as shown in FIG. 1.
Figure 3:
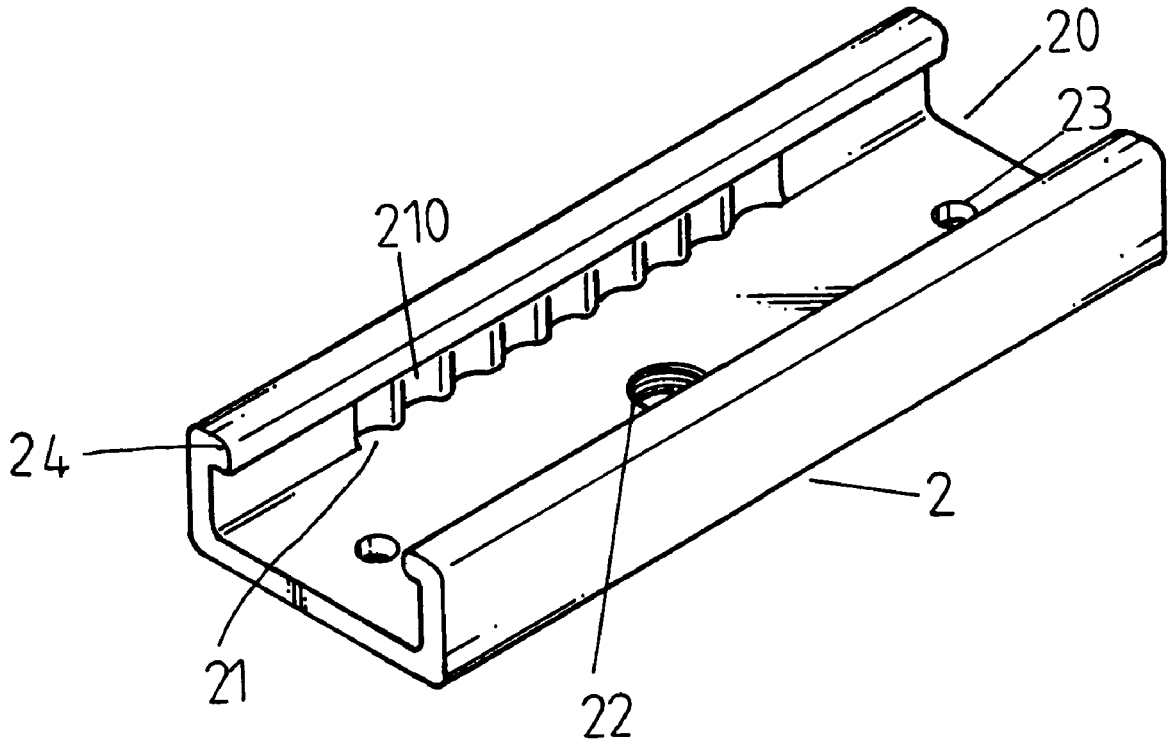
FIG. 3 is a perspective view of a slide of the adjustable armrest assembly as shown in FIG. 2.
Figure 5:
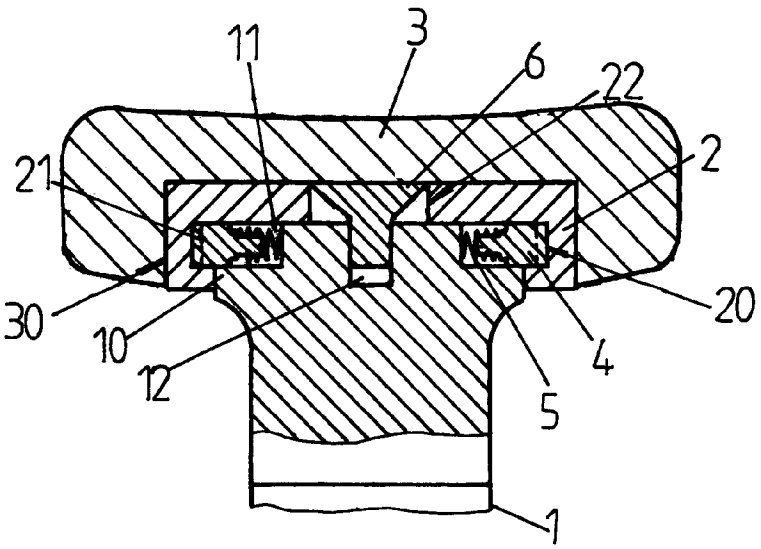
FIG. 5 is a plan cross-sectional view of the adjustable armrest assembly taken along line 5—5 as shown in FIG. 4.
Figure 4:
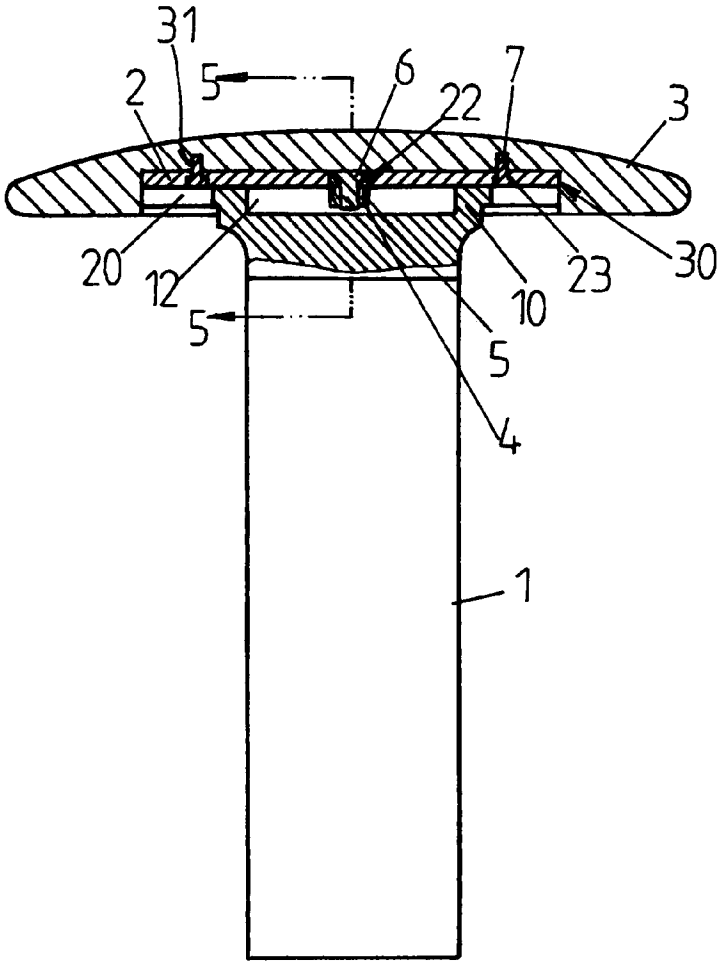
FIG. 4 is a plan cross-sectional view of the adjustable armrest assembly taken along line 4—4 as shown in FIG. 1.

Referring to the drawings and initially to FIGS. 1–5, an adjustable armrest assembly for a chair in accordance with the preferred embodiment of the present invention comprises an arm support 1 having an end formed with a connecting body 10, a slide 2 slidably mounted and detachably locked on the connecting body 10 of the arm support 1, and an armrest 3 secured to the slide 2.

The slide 2 is substantially rectangular and has a substantially inverted U-shaped cross-section. The slide 2 is adjustably mounted on the connecting body 10 of the arm support 1. The slide 2 has an inside formed with a slide slot 20 mounted on the connecting body 10 of the arm support 1. The slide 2 has two side walls each formed with a toothed portion 21 having a plurality of arc-shaped locking grooves 210. Each of the two side walls of the slide 2 has a distal end formed with a hook-shaped limit portion 24 rested on a rim of the connecting body 10 of the arm support 1 to prevent the slide 2 from detaching from the connecting body 10 of the arm support 1. The slide 2 has a face formed with a screw bore 22 communicating with the slide slot 20 and two spaced through holes 23 each communicating with the slide slot 20.

The connecting body 10 of the arm support 1 is substantially rectangular. The connecting body 10 of the arm support 1 has two sides each provided with a locking block 4 detachably engaged with the respective toothed portion 21 of the slide 2, and an elastic member 5 biased between the locking block 4 and the connecting body 10 of the arm support 1 to push the locking block 4 toward the respective toothed portion 21 of the slide 2. The locking block 4 is detachably locked in either one of the locking grooves 210 of the respective toothed portion 21 of the slide 2. Each of the two sides of the connecting body 10 of the arm support 1 is formed with a stepped receiving recess 11 to receive the locking block 4 and the elastic member 5. The connecting body 10 of the arm support 1 has a face formed with an elongated guide slot 12 isolated from the receiving recess 11. A guide screw 6 is screwed into the screw bore 22 of the slide 2 and has a distal end slidably mounted in the guide slot 12 of the connecting body 10 of the arm support 1.

The armrest 3 has an inside formed with a mounting recess 30 mounted on the slide 2. The mounting recess 30 of the armrest 3 is substantially rectangular. The mounting recess 30 of the armrest 3 has a face formed with two spaced screw bores 31. The adjustable armrest assembly further comprises two locking screws 7 each extended through a respective one of the two through holes 23 of the slide 2 and each screwed into a respective one of the two screw bores 31 of the armrest 3 to secure the armrest 3 on the slide 2.

Figure 6:
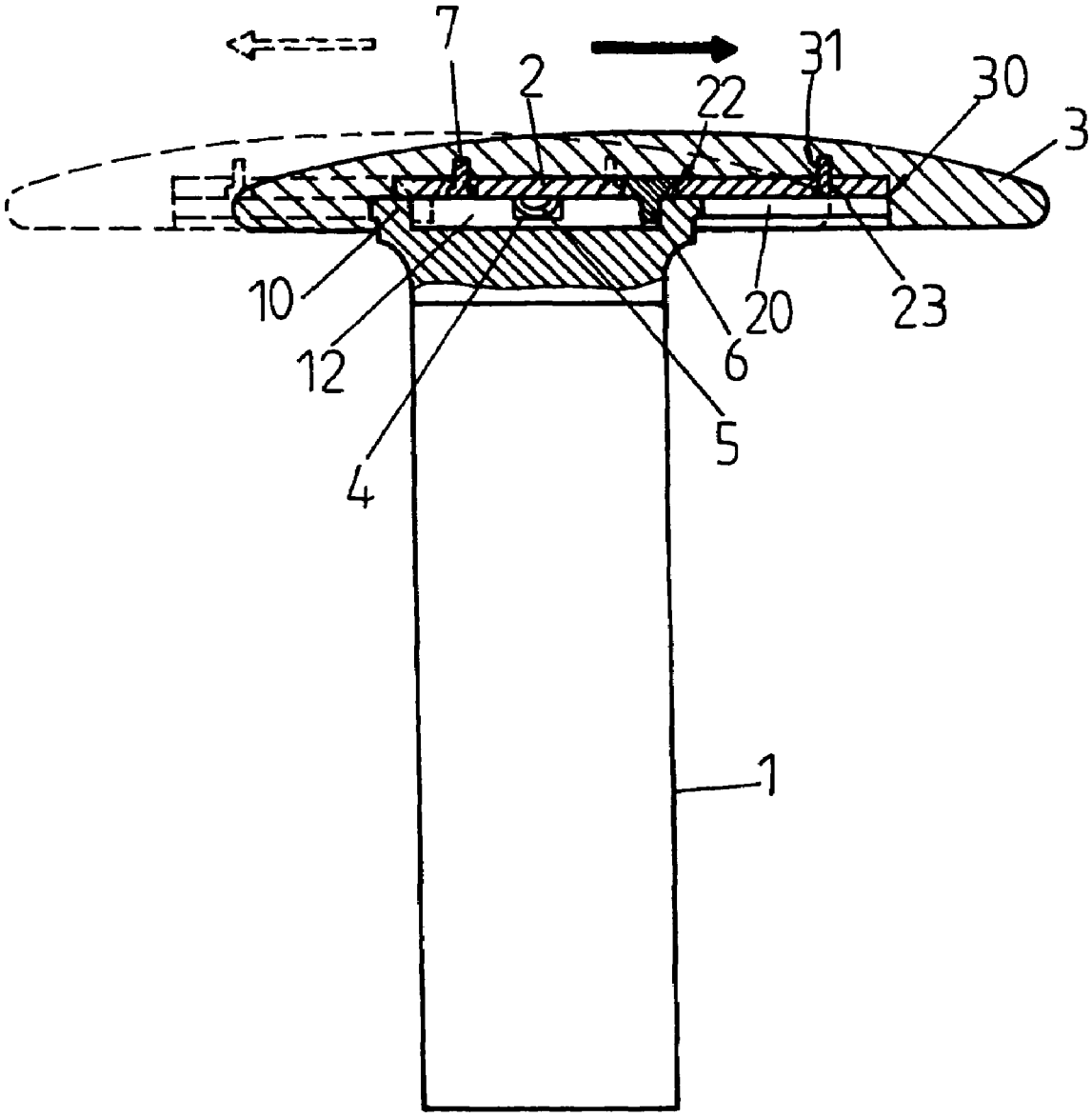
FIG. 6 is a schematic operational view of the adjustable armrest assembly as shown in FIG. 4.

In operation, referring to FIGS. 1–6, the locking block 4 is detachably locked in either one of the locking grooves 210 of the respective toothed portion 21 of the slide 2, so that the slide 2 is positioned on the connecting body 10 of the arm support 1. At this time, the armrest 3 is secured on the slide 2, so that when the armrest 3 is moved by a user, the slide 2 is moved with the armrest 3 to displace on the connecting body 10 of the arm support 1, thereby detaching the locking block 4 from the respective locking groove 210, so as to adjust the relative position between the armrest 3 and the connecting body 10 of the arm support 1. In addition, the guide screw 6 is slidable in the guide slot 12 of the connecting body 10 of the arm support 1 to guide movement of the slide 2. After adjustment of the position of the armrest 3, the locking block 4 is detachably locked in the other one of the locking grooves 210 of the respective toothed portion 21 of the slide 2, so that the slide 2 is positioned on the connecting body 10 of the arm support 1.

Accordingly, the position of the armrest 3 is adjustable to fit users of different statures, so that the user's hands are placed on the armrest 3 in a comfortable manner. In addition, the position of the armrest 3 is adjusted easily and conveniently, thereby facilitating the user adjusting the position of the armrest 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An adjustable armrest assembly, comprising:

an arm support having an end formed with a connecting body;

a slide slidably mounted and detachably locked on the connecting body of the arm support; and an armrest secured to the slide;

wherein the slide has two side walls each formed with a toothed portion and the connecting body of the arm support has two sides each provided with a locking block detachably engaged with the respective toothed portion of the slide, and an elastic member biased between the locking block and the connecting body of the arm support to push the locking block toward the respective toothed portion of the slide.

2. The adjustable armrest assembly in accordance with claim 1, wherein the slide is substantially rectangular.

3. The adjustable armrest assembly in accordance with claim 1, wherein the slide has a substantially inverted U-shaped cross-section.

4. The adjustable armrest assembly in accordance with claim 1, wherein the slide is adjustably mounted on the connecting body of the arm support.

5. The adjustable armrest assembly in accordance with claim 1, wherein the connecting body of the arm support is substantially rectangular.

6. The adjustable armrest assembly in accordance with claim 1, wherein the toothed portion of the slide has a plurality of arc-shaped locking grooves, and the locking block is detachably locked in either one of the locking grooves of the respective toothed portion of the slide.

7. The adjustable armrest assembly in accordance with claim 1, wherein the each of the two sides of the connecting body of the arm support is formed with a stepped receiving recess to receive the locking block and the elastic member.

8. The adjustable armrest assembly in accordance with claim 1, wherein each of the two side walls of the slide has a distal end formed with a hook-shaped limit portion rested on a rim of the connecting body of the arm support.

9. The adjustable armrest assembly in accordance with claim 1, wherein the armrest has an inside formed with a mounting recess mounted on the slide.

10. The adjustable armrest assembly in accordance with claim 9, wherein the mounting recess of the armrest is substantially rectangular.

11. An adjustable armrest assembly, comprising:

an arm support having an end formed with a connecting body;

a slide slidably mounted and detachably locked on the connecting body of the arm support; and an armrest secured to the slide;

the slide has an inside formed with a slide slot mounted on the connecting body of the arm support;

the slide has a face formed with two spaced through holes each communicating with the slide slot, the armrest has a face formed with two spaced screw bores, and the adjustable armrest assembly further comprises two locking screws each extended through a respective one of the two through holes of the slide and each screwed into a respective one of the two screw bores of the armrest to secure the armrest on the slide.

12. An adjustable armrest assembly, comprising:

an arm support having an end formed with a connecting body;

a slide slidably mounted and detachably locked on the connecting body of the arm support; and an armrest secured to the slide;

the slide has an inside formed with a slide slot mounted on the connecting body of the arm support;

the slide has a face formed with a screw bore communicating with the slide slot, the connecting body of the arm support has a face formed with an elongated guide slot, and the adjustable armrest assembly further comprises a guide screw screwed into the screw bore of the slide and has a distal end slidably mounted in the guide slot of the connecting body of the arm support.

* * * * *